United States Patent [19]

Rachman

[11] Patent Number: 4,702,392

[45] Date of Patent: Oct. 27, 1987

[54] VENDING MACHINE

[75] Inventor: Isadore B. Rachman, Philadelphia, Pa.

[73] Assignee: U-Seal-It Vending Co., Inc., Philadelphia, Pa.

[21] Appl. No.: 857,922

[22] Filed: Apr. 30, 1986

[51] Int. Cl.[4] ..... B65H 3/24

[52] U.S. Cl. ..... 221/151; 221/273; 221/274; 221/276; 221/125; 74/99 A

[58] Field of Search ..... 221/125, 272–274, 221/276, 151, 152; 194/251, 255, 292, 296; 74/99 A, 99 R

[56] References Cited

U.S. PATENT DOCUMENTS

| | | | |
|---|---|---|---|
| 378,982 | 3/1888 | Sielaff . | |
| 831,189 | 9/1906 | Rowse . | |
| 1,321,506 | 11/1919 | Bradshaw et al. . | |
| 1,410,635 | 3/1922 | Williams . | |
| 1,652,540 | 12/1927 | Morin . | |
| 2,101,420 | 12/1937 | Scofield | 221/273 |
| 2,432,561 | 12/1947 | DeMott | 221/273 |
| 2,696,324 | 12/1954 | Jones | 221/273 |
| 3,442,200 | 5/1969 | Babel | 221/273 |
| 4,168,784 | 9/1979 | Heiet | 221/125 |
| 4,363,393 | 12/1982 | McDonald | 221/273 |

*Primary Examiner*—H. Grant Skaggs

*Attorney, Agent, or Firm*—Steele, Gould & Fried

[57] ABSTRACT

A vending machine for vending flat packages is disclosed which includes vend assemblies which are reciprocal from a rearward position to a forward, vend position. The vending machine is equipped with a rotary coin accepting assembly including a handle, a shaft and a circular cam affixed to the shaft to be rotated when the handle is turned. An activator rod extends forwardly from a reciprocating portion of the vend assembly and includes an operating finger which is positioned to be contacted by the circular cam when the handle is rotated in response to acceptance of a coin. The contact between the circular cam and the activator rod drives the vend assembly to its rearwardmost position to again prepare the vending machine for vending a flat package.

6 Claims, 7 Drawing Figures

FIG. 1
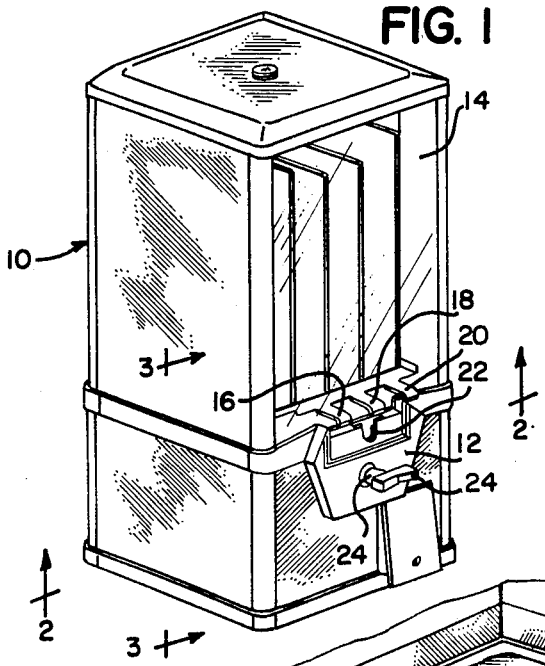
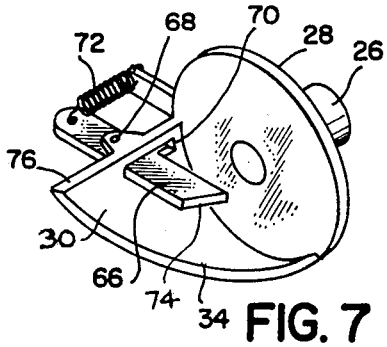
FIG. 7
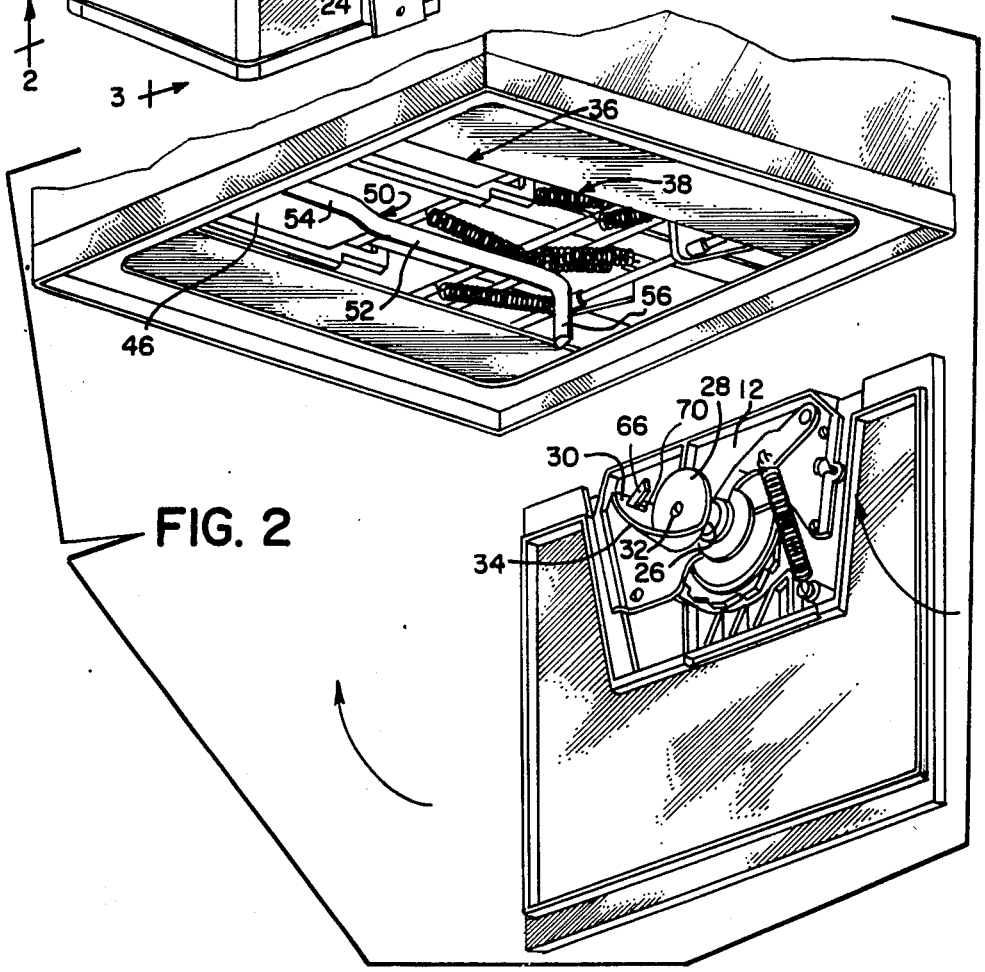
FIG. 2

VENDING MACHINE

BACKGROUND OF THE INVENTION

1. Field of the Invention

The present invention relates generally to vending machines, and more particularly, is directed to a flat package vending machine having a rotary type coin accepting apparatus as the actuating mechanism.

2. Description of the Prior Art

Numerous types of coin operated vending machines have been and are currently in common use throughout the country to vend a multitude of diverse products. The prior and current type vending machines encompass various types of mechanical operators, electrical operators and numerous combinations of both. The devices presently in use can vary from the simplest type of mechanical designs to highly sophisticated electrically and electronically functioned machines. Generally speaking, the presently available coin operated vending machines are usually installed and deployed in and about congested and quite costly commercial space, for example within stores, public areas, theaters and other places which tend to attract large crowds of people, and consequently, large crowds of potential purchasers.

Due to the highly restricted nature of the areas which are currently made available to accommodate vending machines, such vending space is always at a premium. The very limited space that can be committed to vending operations requires a highly efficient and attractive vending machine installation program in order to maximize the expected return. Because of the highly restrictive space made available for vending machines, such spaces have tended to become over utilized and crowded. Quite often, numerous machines vending different products are installed together in gangs in a manner to vend the maximum number of products in a minimum amount of space. Under such conditions, it is almost always necessary to provide strictly front coin acceptance and product delivery to maximize the efficiency of the available vending space. Due to the nature of the industry, current vending machines have tended to become standardized in size and type of operation to thereby facilitate the placement and interchanging of machines, either singly or in any desired multiples.

The industry standard at this time appears to be approaching a modular type of vending machine that is approximately ten inches by ten inches in cross sectional dimensions, approximately twenty-four inches high having a removable top for servicing and being equipped with a rotary type coin accepting mechanism for vending.

Such rotary coin accepting mechanisms are well known in the art and are quite reliable and efficient when vending small, three dimensional articles, for example gum, candy and similar products. However, in those instances where it is intended to vend a substantially two dimensional article, for example a card or other flat object, it has heretofore been the common practice to employ horizontal, reciprocating type of coin chutes, which chutes function to both accept and move coins in a horizontal plane and to simultaneously arm the mechanism for repeated horizontal dispensing of the flat packages. U.S. Pat. No. 4,168,784, entitled "Flat Package Vending Machine", which is owned by the assignee of the present application, is typical of a prior are type flat package vending machine which incorporates horizontal coin slides. While such prior art flat package vending machines function satisfactorily to efficiently vend a number of diverse items contained in flat package arrangement, the popularity of such prior art flat package vending machines has suffered due to their inherent need for additional floor space for display and vending purposes.

SUMMARY OF THE INVENTION

The present invention relates generally to vending machines suitable for accepting coins and for dispensing flat packages, and more particularly, is directed to a flat package vending machine including a rotary coin accepting mechanism that is suitable for use in a highly restrictive area.

The present invention includes a body or chassis that is in conformance with the newly developing vending industry standard in size and configuration. In view of the limited space currently available for vending machine purposes, the configuration of the presnt vending machine has been designed to be approximately ten inches by ten inches in cross sectional dimensions and approximately twenty-four inches in height. A rotatable type coin accepting mechanism has been employed and the device has been designed for front coin accepting and vending. The vending machine has been designed with a removable cover which can be functioned from above to permit top servicing of the unit.

A known type of rotary coin accepting mechanism has been altered as necessary to provide a rotary cam that has been designed to convert the rotary movement of the handle upon accepting a properly sized coin to horizontal, linear movement to activate the flat package vending mechanism. A bottom, horizontally movable channel is employed in known manner to move the various vend plates to their rearward positions in a manner to initiate the vending cycle. The bottom positioned channel has been equipped with a bottom connected extension bar or activator rod with depending lever to facilitate horizontal rearward movement in response to rotary movement of the vending mechanism handle and shaft. The vend handle shaft is inwardly equipped with a circular cam of design to engage the depending lever of the activator rod when a coin is inserted and the vend handle is turned. The rotary action of the handle, acting through the interaction of the circular cam and the activator rod, urges the channel member rearwardly in a manner to initially arm the plurality of vend assemblies to thereby permit vending of any one of a number of flat package items. Once the flat package item has been vended, the bottom channel and the affixed extension bar or activator rod will be forwardly urged to lock the mechanism against additional vending or pilferage, until such time as the vend cycle is repeated by the insertion coin and the turning of the vend handle.

In this manner, a flat package vending machine with front, rotary coin accepting has been developed which can conform to industry standards as to space requirements. Additionally, the vending machine of the present application is capable of vending flat packages at the machine front only to thereby not unduly encumber the available vending floor space. A removable top permits top access into the device for servicing, coin removal, etc. in the same manner now utilized in conjunction with vending machines handling three dimensional articles.

It is therefore an object of the present invention to provide an improved vending machine of the type set forth which is capble of flat package vending in a limited floor space environment.

It is another object of the present invention to provide anovel vending machine which is adapted to store and to dispense a plurality of various flat package products in a machine having front access only.

It is another object of the present invention to provide a novel vending machine which is equipped with a rotary coin accepting mechanism and a horizontal vend assembly activator rod which is adapted to be horizontally rearwardly urged upon rotation of the vend handle.

It is another object of the present invention to provide a novel vending machine comprising a flat package vending assembly, a horizontally movable channel member to initially arm the vend assembly, an activator rod with operating finger affixed to the channel, a rotary, coin accepting mechanism including a turnable handle, a circular cam affixed to the handle shaft in position to contact the activator rod, whereby the activator rod and the affixed operating channel will be rearwardly urged upon rotation of the handle.

It is another object of the present invention to provide a novel mechanical vending machine that is simple in design, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESRIPTION OF THE DRAWINGS

FIG. 1 is a front perspective view of the vending machine of the present application showing the rotary coin accepting mechanism.

FIG. 2 is an enlarged, partial, bottom exploded, perspective view looking from line 2—2 on FIG. 1.

FIG. 7 is a partial, detailed view showing the activator rod locking pawl.

DESCRIPTION OF THE PREFERRED EMBODIMENT OF THE INVENTION

Figure 3:
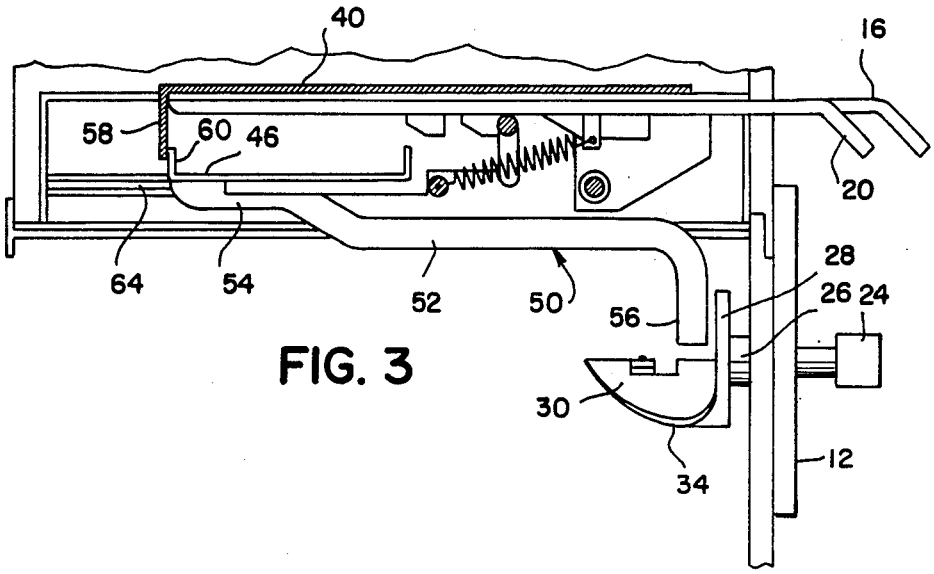
FIG. 3 is an enlarged, partial, cross sectional view taken along line 3—3 on FIG. 1, looking in the direction of the arrows and showing the activator rod and vend assembly in a first, non-vend position.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIG. 1 a flat package vending machine 10 which comprises generally a machine front 14 within which is positioned a lower coin accepting assembly 12 and a plurality of similar, horizontally operating flat package vend levers 16, 18, 20. The coin accepting assembly 12 is conventional in design and operation and includes a coin receiving slot 22, a handle 24 and an operating shaft 26 which is rotatable upon insertion of a coin into the coin slot 22 to permit rotation of the handle 24 in known manner.

Referring to FIG. 2, the rear operating components of the coin accepting assembly 12 can be seen. A cam plate 28 to which a circular cam 30 is welded or otherwise affixed is secured to the inward end of the handle shaft 26 in a suitable, secure manner, for example by employing a threaded fastener 32. When a coin is inserted into the coin receiving slot 22 for vending purposes, the mechanism permits the handle 24 to be rotated to initiate the vend cycle, thereby correspondly rotating the handle shaft 26 and the affixed circular cam 30. As illustrated, the circular cam 30 comprises a peripheral forwardly curved, cam surface 34 of configuration designed to transfer the rotary motion of the handle shaft 26 into horizontal, linear movement of a reciprocal portion 36 of the flat package vending assembly 38.

The flat package vending assembly 38 has been fully illustrated and described in the said U.S. Pat. No. 4,168,784 and so need not be additionally described at this time. Suffice it to say that the vend levers 16, 18, 20 are individually associated with respective vend plates 40, 42, 44 (FIGS. 4 and 6) and function to pull a vend plate forwardly individually in response to a vend operation. Upon completion of the vending operation, the vending assembly interlocking mechanism prevents additional vending until such time as another coin is inserted into the coin slot 22 and the coin accepting assembly 12 is functioned to push the button transverse channel member 46 rearwardly as indicated by the arrow 48 in FIG. 6. The rearward urging of the bottom channel member 46 functions to rearwardly urge any of the vent plates 40, 42, 44 that had previously been activated for vending purposes, all as described in the said U.S. Pat. No. 4,168,784.

Figure 4:
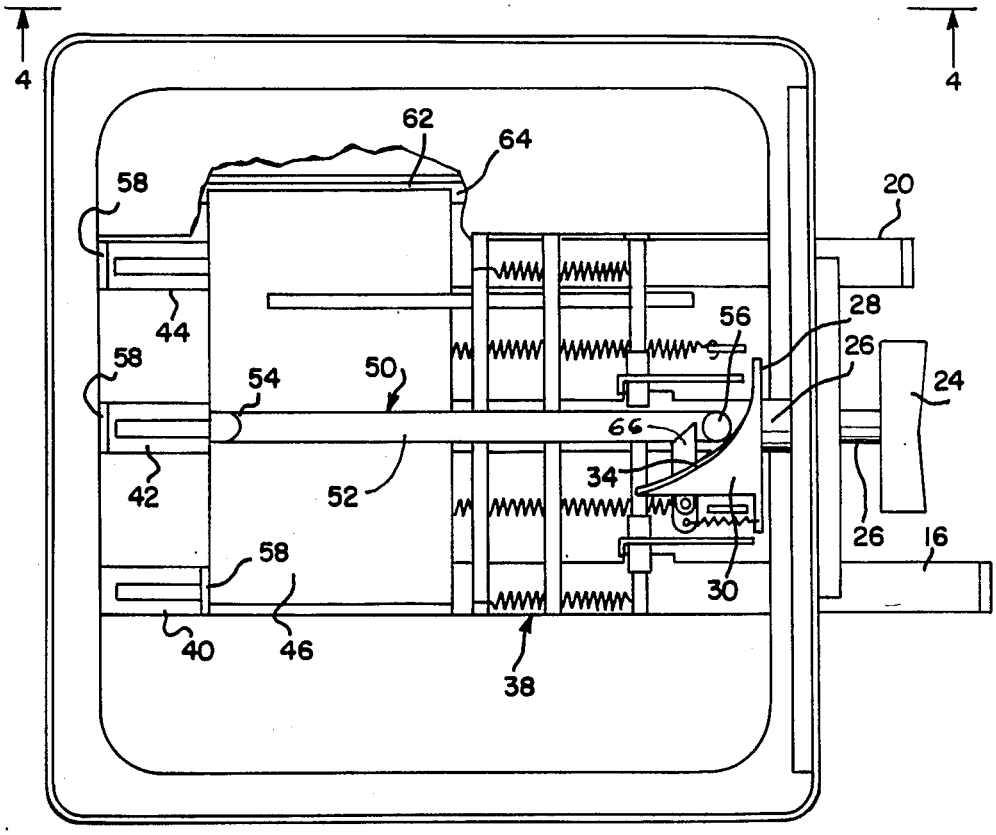
FIG. 4 is a bottom plan view of the vend mechanism, looking from line 4—4 on FIG. 3.

As shown in FIGS. 2, 3 and 4, the activator rod or extension bar 50 comprises an elongated body 52 which terminates rearwardly in a connection end 54 and forwardly in depending operating finger 56. Preferably, the operating finger 56 is fabricated to a round cross sectional configuration so as to have a substantially point contact and rolling action upon the forwardly curved cam surface 34 when the cam is rotated by the handle to start the vending operation.

As illustrated in FIGS. 3 and 4, upon the completion of a vending cycle, when any one of the flat package vend levers 16, 18, 20 is pulled forwardly in the usual manner to vend a flat package (not illustrated), the downwardly depending flange 58 of a vend plate 40, 42, 44 will engage the rearward leg 60 of the transverse bottom channel member 46 to simultaneously push the channel member forwardly. See FIG. 3. The movement of the channel member 46 to its forward position will also cause simultaneous forward movement of the affixed activator rod 50 whereby the activator rod operating finger 56 will be moved to its forwardmost position within the vending machine 10. When moved to the forwardmost position, the operating finger 56 will be located in a position where it will be contacted by the curved cam surface 34 when the circular cam 30 is rotated upon operation of the machine handle 24.

Figure 5:
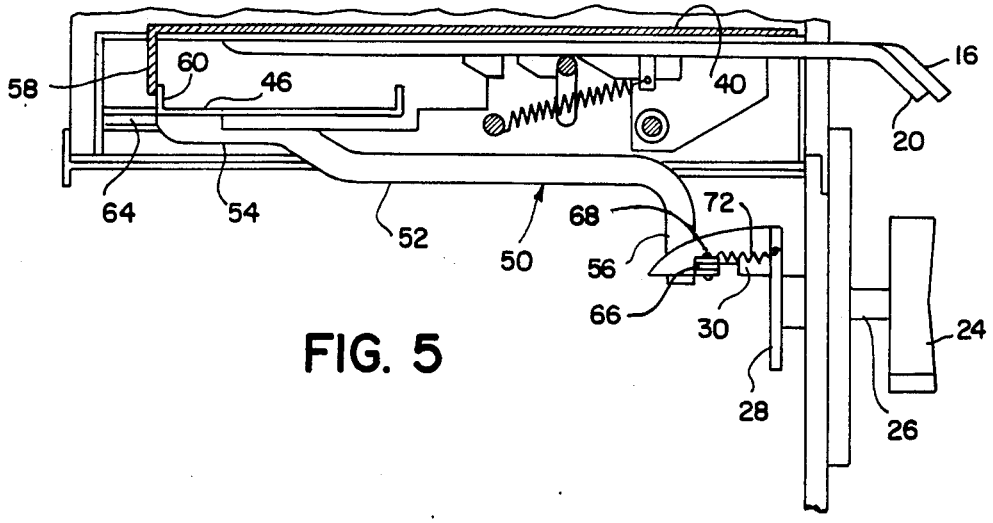
FIG. 5 is a partial, cross sectional view similar to FIG. 3, showing the vend assembly being urged towards its rearward, vend position.
Figure 6:
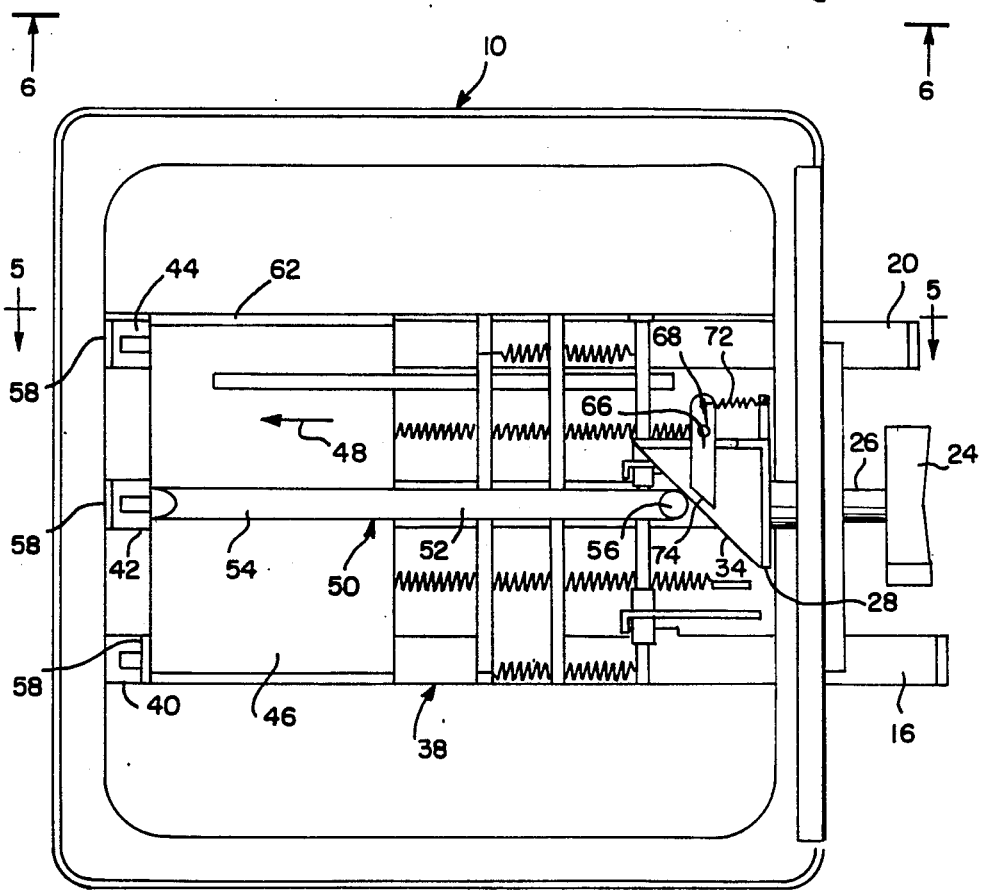
FIG. 6 is a bottom plan view of the apparatus in position illustrated in FIG. 5, looking from line 6—6 on FIG. 5.

As illustrated in FIGS. 5 and 6, upon the insertion of a coin within the coin receiving slot 22, the handle 24 can then be rotated in accordance with the usual operation of the coin accepting assembly 12 to thereby rotate the handle shaft 26 and the affixed cam plate 28 and circular cam 30. When the cam 30 is rotated, the curved cam surface 34 will contact in substantially point contact the outer periphery of the operating finger 56 in a substantially rolling action of the cam relative to the extension bar operating finger. The forwardly curved cam surface 34 is so configured as to increasingly drive the operating finger and the attached bottom channel member 46 increasingly rearwardly as the handle 24 is turned.

As illustrated, the interaction of the rearward leg 60 of the bottom channel member 46 with the depending vent plate rear flange 58 will cause the associated vend plate also to be rearwardly urged until the vend plate and its depending flange 58 reach their initial, rearward vend position. Once the vend plate and attached depending flange 58 are positioned in the initial position, the associated vend lever 16, 18, 20 can be pulled forwardly to vend the selected flat package (not illustrated) in the usual manner. Of course, the forward pulling of a vend lever 16, 18, 20 will simultaneously pull its associated vend plate and the transverse channel member 46 and the connected activator rod 50 forwardly to the interlocked position illustrated in FIGS. 3 and 4. With the parts so positioned, the vending machine 10 interlocking mechanisms will function to prevent the delivery of additional flat packages until another coin is inserted into the coin receiving slot 22 to enable the vending cycle to be repeated.

As best seen in FIGS. 4 and 6, the activator rod 50 is affixed to the transverse channel member 46 in substantial longitudinal alignment whereby the rearward forces generated by the rotary action of the curved cam surface 34 upon the outer periphery of the operating finger 56 will produce axially aligned, rearwardly directed forces to facilitate rearward movement of the transverse channel member 46 without any tendency to angularly cock or otherwise cause the channel member transverse edges 62 to bind or otherwise become obstructed within the transverse tracks 64 (FIG. 4). Due to the respective shapes of the cam surface 34 and the round periphery of the operating finger 56, the contact therebetween can best be described as a rolling point contact as the circular cam 30 is rotated to drive the activator rod 50 and the connected channel member 46 rearwardly. It is thus seen that rotary movement of the circular cam 30 can produce corresponding linear, rearwardly directed movement of the activator rod 50, the affixed transverse channel member 46 and the previously utilized vent plate 40, 42 or 44.

As best seen in FIG. 7, and as additionally illustrated in FIGS. 2, 4 and 5, the circular cam 30 is equipped with an additional interlocking means which may be a spring biased pawl 66 to retain the operating finger 56 in association with the cam 30 upon completion of a vend cycle. It has been found desirable to additionally lock the activator rod after vending to prevent tampering with the machine contents without payment of the established vend price. In one embodiment, the interlocking means can comprise a pawl 66 which is pivotally affixed to the cam 30 through a pivot pin 68. The pawl 66 includes an inclined forward surface 74 which is normally positioned to be engaged by the operating finger 56 during the vend cycle. When the operating finger 56 is forwardly pulled during each vend operation, the contact with the inclined surface 74 causes the pawl 66 to pivot relative to the cam 30 until the operating finger forwardly passes the pawl. The pawl spring 72 then functions to pivot the pawl 66 back to its initial position against the stop 70, thereby temporarily restraining any tapering rearward movement of the activator rod 50. Normal rotation of the cam 30 upon proper operation of the vending machine will automatically rotate the pawl 66 clear of the operating finger 56 to allow the usual, cam-urged, rearward movement of the activator rod and the attached bottom channel member 46.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. In a flat package vending machine of the type including a flat package vend assembly having a reciprocating vend plate, a rearward flange downwardly depending from the vend plate, a reciprocal channel member positioned to be contacted by the depending flange and a vend lever in releasable contact with the vend plate to pull the vend plate and the channel member forwardly for flat package vending, the improvement comprising a rotary coin accepting assembly affixed to the vending machine and being capable of being rotated upon acceptance of a proper coin;

a cam means positioned rearwardly of the coin accepting assembly and being rotatable by the coin accepting assembly, the cam means comprising a generally cylindrical, hollow cam, the cam having a curved cam surface; and an activator rod secured to the channel member, the activator rod being positioned to be contacted by the curved cam surface to drive the channel member and vend plate rearwardly upon rotation of the coin accepting assembly, the activator rod being pulled forwardly by the vend lever upon each vend cycle, the activator rod comprising an elongated body, the body terminating rearwardly in a connection end and forwardly in a downwardly depending round finger, the connection end being secured to the channel member, the depending finger being in rolling point contact with the curved cam surface when the rotary coin accepting assembly is rotated.

2. The vending machine of claim 1 wherein the channel member comprises a longitudinal axis and wherein the activator rod is positioned in alignment with the longitudinal axis.

3. The vending machine of claim 1 wherein the cam means comprises a generally hollow circular cam having a curved cam surface, the said cam surface terminating rearwardly in a point.

4. In a flat package vending machine of the type including a flat package vend assembly having a reciprocating vend plate, a rearward flange downwardly depending from the vend plate, a reciprocal channel member positioned to be contacted by the depending flange and a vend lever in releasable contact with the vend plate to pull the vend plate and the channel member forwardly for flat package vending, the improvement comprising a rotary coin accepting assembly affixed to the vending machine and being capable of being rotated upon acceptance of a proper coin;

a cam means positioned rearwardly of the coin accepting assembly and being rotatable by the coin accepting assembly;

an activator rod means secured to the channel member, the activator rod means being positioned to be contacted by the cam means to drive the channel member and vend plate rearwardly upon rotation of the coin accepting assembly, the activator rod means being pulled forwardly by the vend lever upon each vend cycle; and activator rod interlocking means secured to the cam means to prevent movement of the activator rod means prior to rotation of the rotary coin accepting assembly.

5. The vending machine of claim 4 wherein the interlocking means comprises a pawl pivotally connected to the cam means.

6. The vending machine of claim 5 wherein the pawl comprises an inclined surface, the inclined surface being so positioned as to be contacted by a portion of the activator rod means as the activator rod means is forwardly pulled by a vend lever.

* * * * *